US005401163A

United States Patent [19]

Yamazaki

[11] Patent Number: 5,401,163

[45] Date of Patent: Mar. 28, 1995

[54] GAS LIGHTER WITH SAFETY DEVICE

[75] Inventor: Nobuo Yamazaki, Shizuoka, Japan

[73] Assignee: Tokai Corporation, Kanagawa, Japan

[21] Appl. No.: 60,234

[22] Filed: May 11, 1993

[30] Foreign Application Priority Data

May 12, 1992 [JP] Japan ..... 4-118896

[51] Int. Cl.[6] ..... F23Q 2/00

[52] U.S. Cl. ..... 431/129; 431/152; 431/153

[58] Field of Search ..... 431/153, 152, 277, 129, 431/255, 254; 222/153, 402.11, 384; 251/77, 78

[56] References Cited

U.S. PATENT DOCUMENTS 2,618,140 11/1952 Zellweger ..... 431/152
3,251,202 5/1966 Racek ..... 431/150
4,190,412 2/1980 Nitta ..... 431/152 X
5,035,608 7/1991 Parren ..... 431/153

FOREIGN PATENT DOCUMENTS 2062200 5/1981 United Kingdom .

*Primary Examiner*—Larry Jones
*Attorney, Agent, or Firm*—Brumbaugh, Graves, Donohue & Raymond

[57] ABSTRACT

A gas lighter with a child-proof safety device which can reduce wasteful evolution of gas. The lighter is provided with a flick-up type cap which closes and opens the upper part of a lighter body, an operating grip which obliquely projects out of a lateral surface of the lighter body in response to the opening action of the cap, and a linkage means for causing gas to be evolved in connection with a depression of the operating grip. Ignition of the lighter can be carried out by igniting operations of the operating grip while the cap is opened.

2 Claims, 5 Drawing Sheets

GAS LIGHTER WITH SAFETY DEVICE

BACKGROUND OF THE INVENTION

1. Field of the Invention

This invention relates to a gas lighter with a safety device, and more particularly to a gas lighter with a so-called child resistant safety device which prevents inadvertent ignition by preventing the evolution of gas while the lighter is not in use.

2. Description of the Prior Art.

A gas lighter with a cap causes gas to be evolved associatedly with the opening action of the cap, and this type of lighter can be readily ignited either by the rotation of a file which is in contact with a flint or by the operation of a piezoelectric ignition device. Once produced, the fire will not go out until the cap is closed, and hence inadvertent ignition of the lighter is a safety hazard for those who, like children, are unfamiliar with the proper use of the lighter.

For this reason, there is a demand for a safer gas lighter which prevents inadvertent ignition by those who, like children, are unfamiliar with operation thereof. Heretofore, gas lighters with various types of safety devices have already been proposed. These safety devices are provided with a lock mechanism which hinders the depression of an ignition lever without the release of the lock mechanism. However, any of these lighters have drawbacks in their usage, and thus it is desirable that the gas lighter be improved for practical use.

Conventional child resistant safety devices are designed to prevent igniting operations. In the case of a gas lighter with a cap which causes gas to be evolved by the opening of the cap, gas is evolved even when the igniting operations are hindered, thereby resulting in wasteful consumption of gas. Devices which are safer and easier to operate are therefore desired.

SUMMARY OF THE INVENTION

In view of the foregoing observations and descriptions, the object of this invention is to provide a gas lighter with a safety device which does not cause gas to be evolved only by the opening of the cap, thereby preventing the wasteful consumption of gas, and to provide a gas lighter with a safety device which is safer, as a child resistant safety device, and superior in operability.

To this end, according to one aspect of this invention, there is provided a gas lighter with a safety device having a lighter body which includes a fuel tank for storing fuel to be ignited and a valve mechanism for supplying fuel from the fuel tank at a regulated flow rate, an ignition means for igniting the supplied fuel, and a flick-up type cap for closing and opening the upper part of the lighter body and ignition means, the improvement characterized in that there are also provided an operation grip means which protrudes beyond a surface of the lighter body in response to the opening action of the cap, and a linkage means for actuating the valve mechanism in connection with a depression of the operation grip so that gas can be evolved.

According to the gas lighter with a safety device of the present invention, when the lighter is not in use while the cap is closed, the operating grip is kept in alignment with a lateral surface of the lighter body, and hence it is impossible to cause gas to be evolved. Meanwhile, when the lighter is ready to operate while the cap is opened, the operating grip protrudes beyond the lateral surface of the lighter body in response to the opening of the cap. While the operating grip projects beyond the surface of the lighter body, gas is not evolved, and the lighter is prevented from being ignited even when the igniting means is operated, whereby inadvertent ignition is prevented, and it is possible to reduce a consumption rate by avoiding the unnecessary evolution of gas. At the time of ignition of the lighter, gas is evolved by depressing the operating grip that has projected in response to the opening of the cap, and then the lighter gas is ignited by operating the igniting means while the gas is evolved. Upon release, the operating grip returns to its projected state, so that lighter goes off. Closing the cap brings the operating grip in alignment with the surface of the lighter body, whereupon the lock mechanism automatically operates, whereby it becomes possible to achieve a significantly safer gas lighter.

DETAILED DESCRIPTION OF THE EMBODIMENT

With reference to the accompanying drawings, a preferred embodiment of this invention will now be described.

Figure 1:
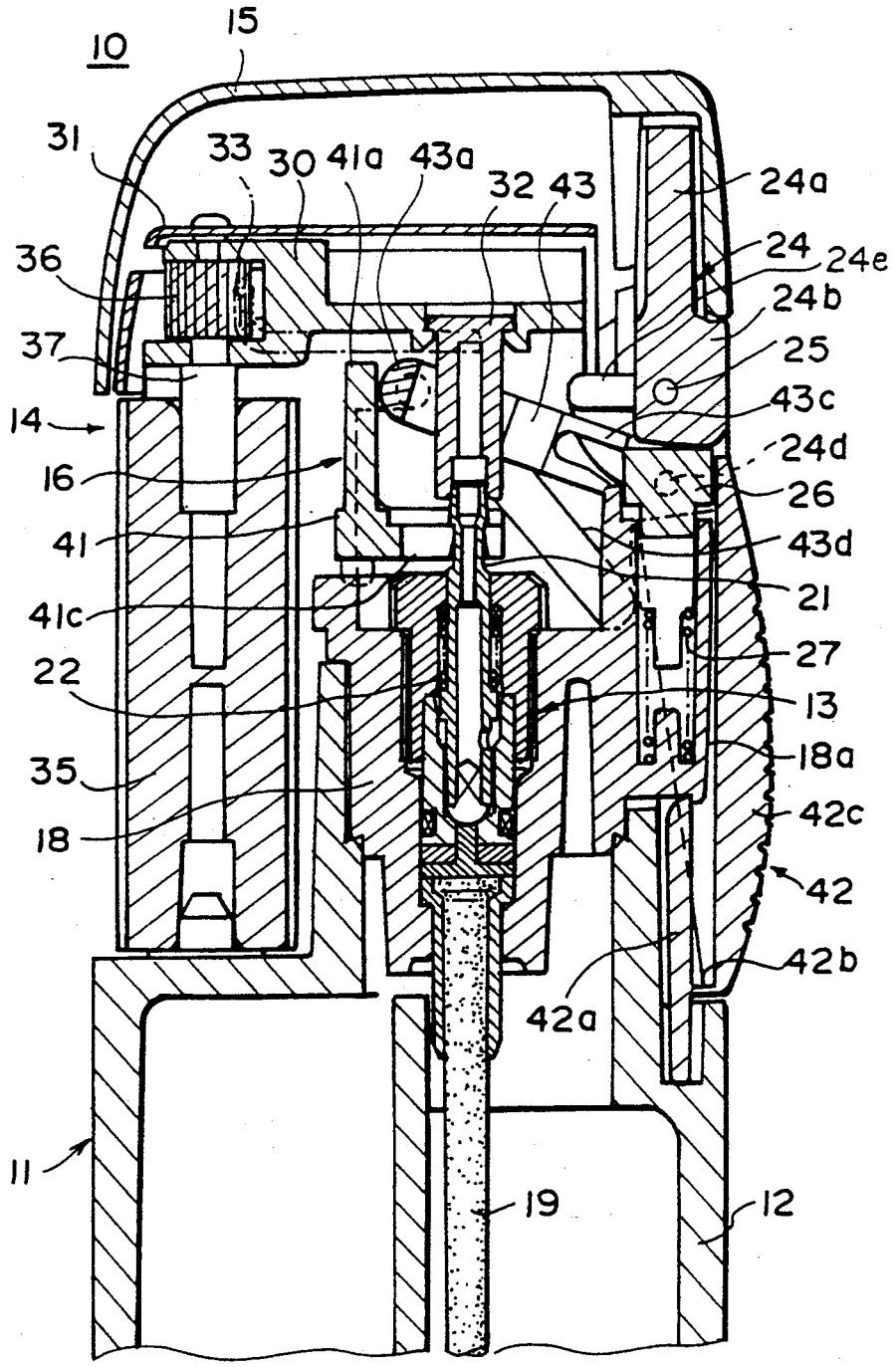
FIG. 1 is a longitudinal cross-sectional view showing the chief portion of a gas lighter with a safety device according to one embodiment of this invention.
Figure 2:
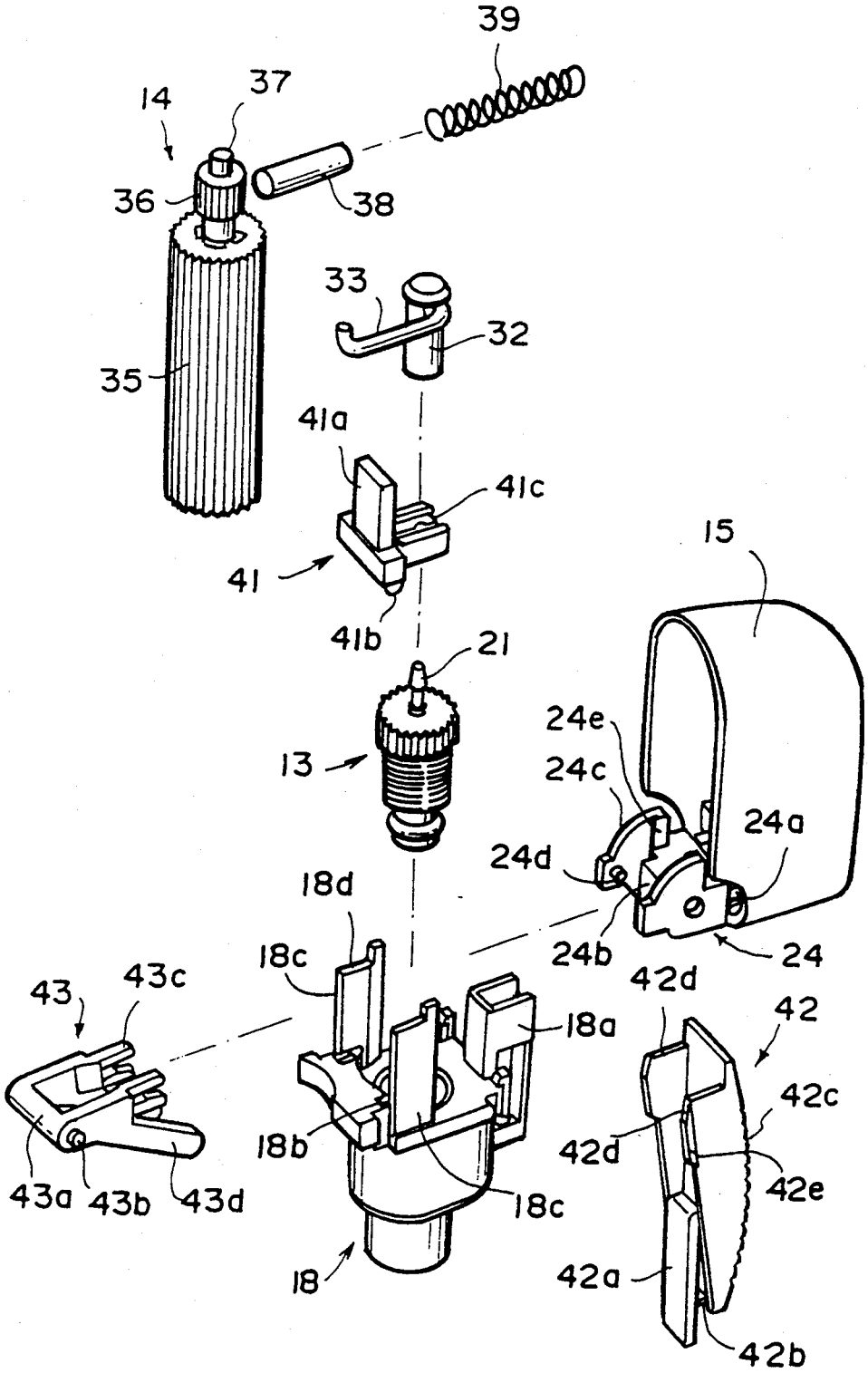
FIG. 2 is an exploded perspective view showing chief components of the gas lighter shown in FIG. 1.
Figure 3:
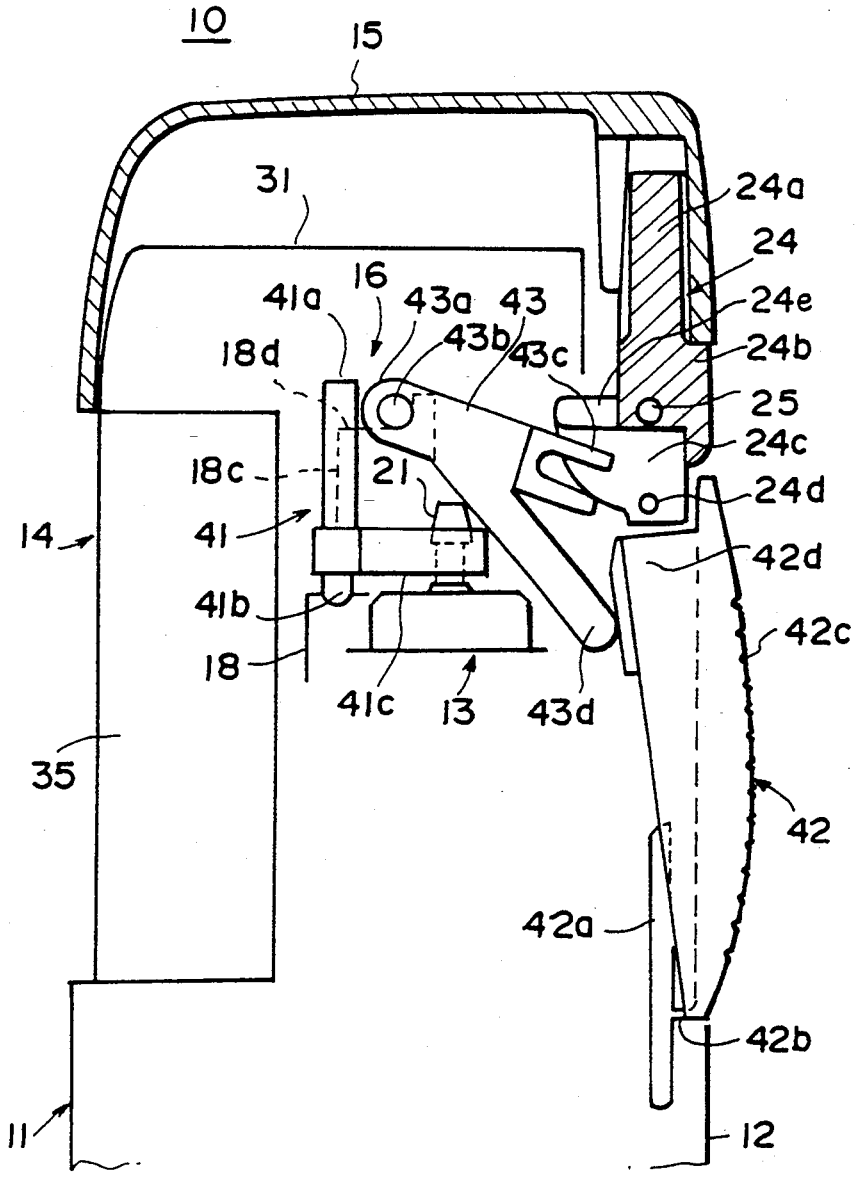
FIG. 3 is a fragmentary cross-sectional side elevation view showing the chief components of the gas lighter shown in Figure.1 when the lighter cap is closed.
Figure 4:
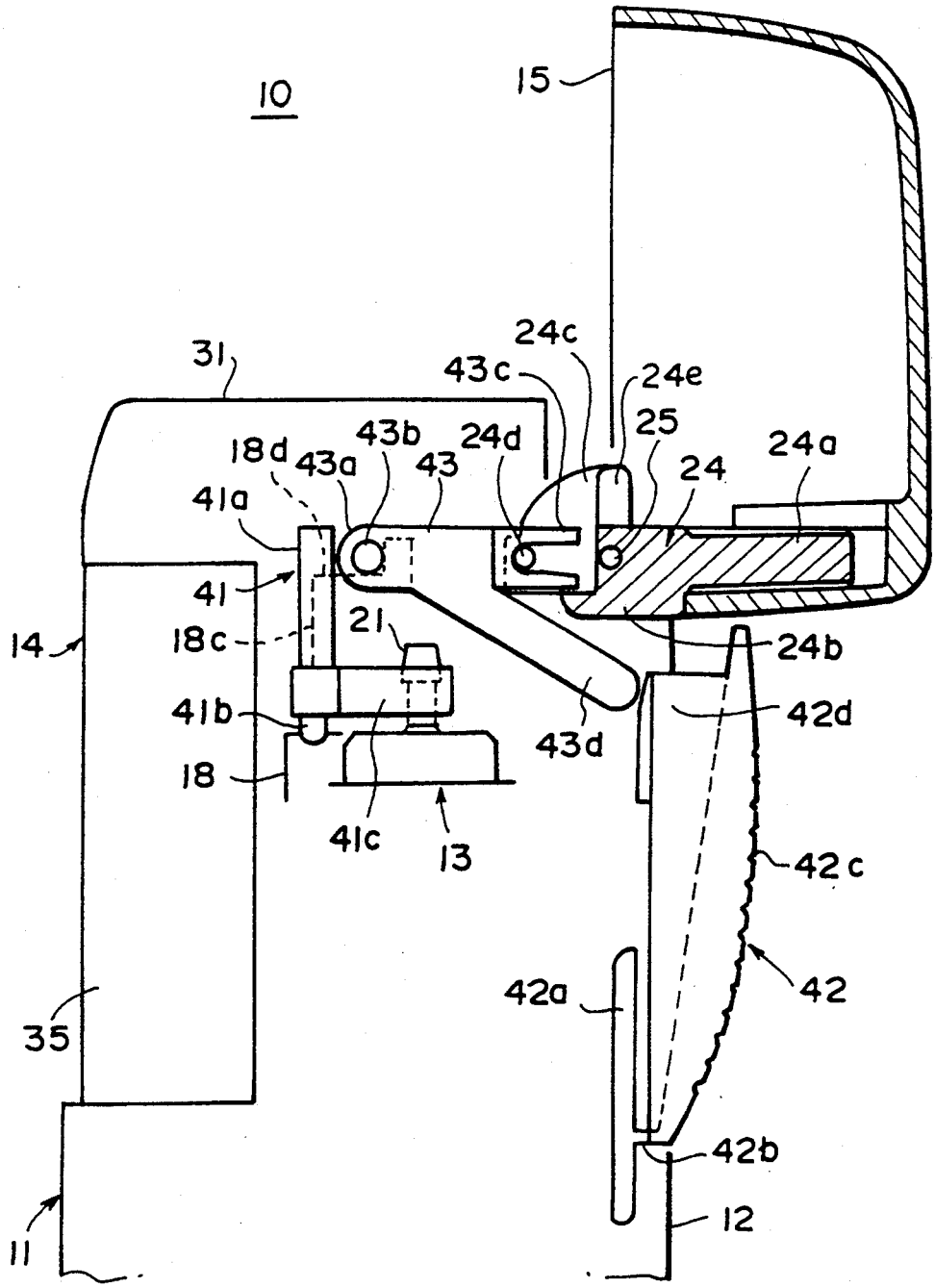
FIG. 4 is a fragmentary cross-sectional side elevation view showing the chief components of the gas lighter shown in FIG. 1 when the lighter cap is opened.
Figure 5:
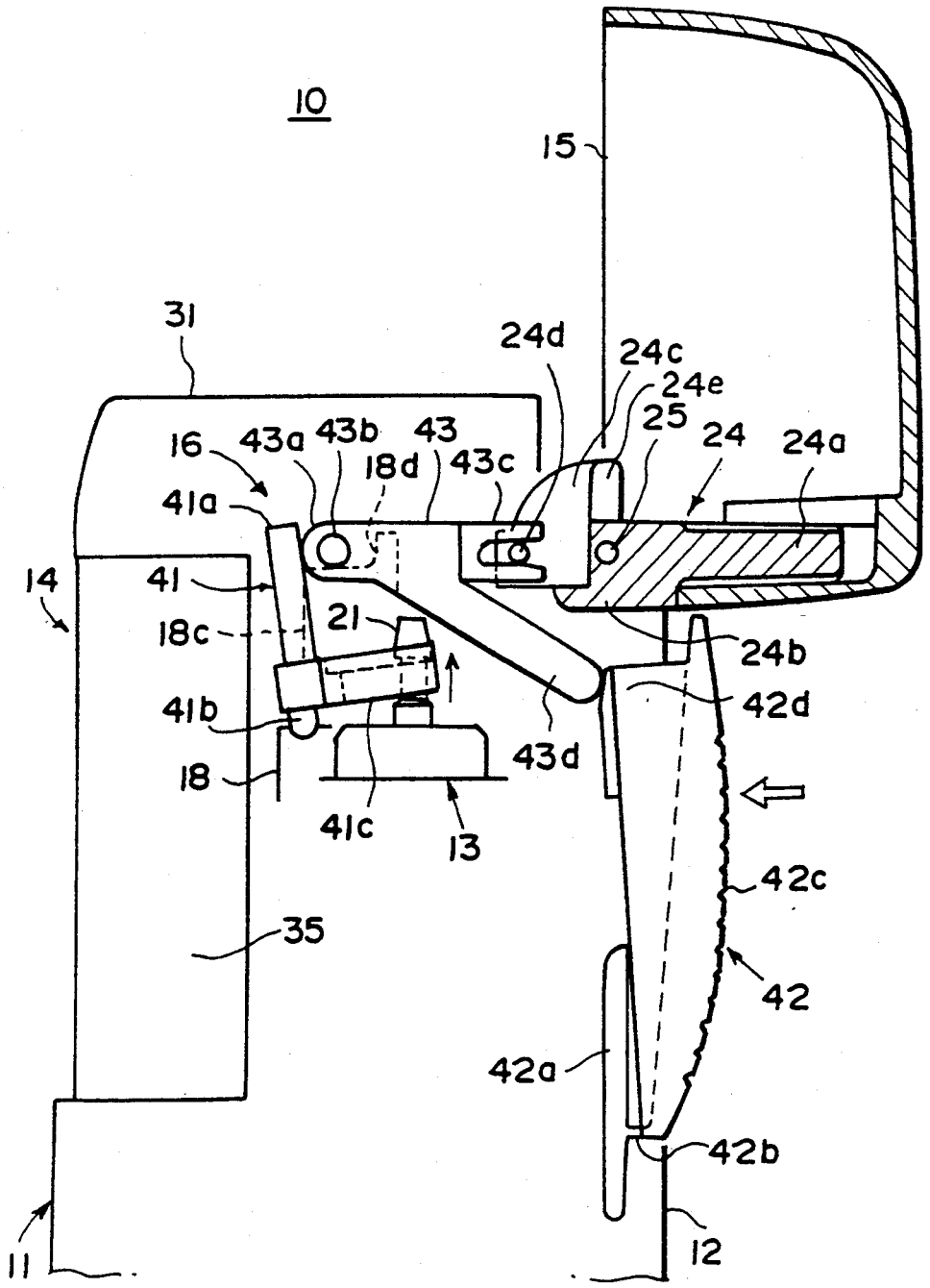
FIG. 5 is a fragmentary cross-sectional side elevation view showing the chief components of the gas lighter when it is ignited.

FIG. 1 shows a gas lighter according to one embodiment of this invention when it is not in use; FIG. 2 is an exploded perspective view showing the chief portion of the lighter; and FIGS. 3 through 5 are structural drawings showing the action of a safety device.

A gas lighter 10 is provided with a gas lighter body 11 including a fuel tank 12 and a valve mechanism 13, an ignition means 14, and a flick-up cap 15 for closing and opening the upper part of the lighter body 11.

A fuel tank 12 for the lighter body 11 is connected to an upper tank closure 18 which is situated above the fuel tank, and is also connected to a non-illustrated bottom closure, thereby constituting a cavity for containing high pressure gas. The upper tank closure 18 is provided with a valve mechanism 13 for closing and opening the supply of gas from the fuel tank 12. A core 19 is inserted in the fuel tank 12, and gas is supplied through this core 19. A nozzle 21 for the valve mechanism 13 is interposed in this path for gas flow. Elevation of this nozzle member 21 causes the gas flow path to open, so that gas is supplied. Returning of this nozzle by means of a spring 22 causes the gas flow path to close, whereupon the supply of gas is stopped.

The thin surrounding wall of the fuel tank 12 extends upwards, although this is not shown in the drawings, and a cap 15 is movably mounted on the top of this side wall. In detail, a support portion 24a of a pivot member 24 is fitted on one end of the cap 15 which covers the upper part of this lighter body 11. A base portion 24b of this pivot member 24 is pivotally supported on the non-illustrated surrounding wall by means of a cap pin 25. The cap 15 rotatably opens and closes around the cap pin 25 in response to the rotation of the pivot member 24. As shown in FIG. 2, a sector-shaped side wall 24c is provided on each side of the pivot member 24. An engaging protuberance 24d which inwardly projects is provided at one end of the side wall 24c with respect to the cap pin 25. In addition, a raised portion 24e which extends at a substantially right angle to the longitudinal direction of the support portion 24a is formed next to the position in the side plate 24c where the cap pin 25 is supported, and the raised portion 24e projects into the base portion 24b.

The base portion 24b of the pivot member 24 is thrusted upwardly by an up-thrusting member 26, whereby the cap 15 is held in the closed position (see FIGS. 1 and 3) and open position (see FIGS. 4 and 5). This up-thrusting member 26 is vertically movably inserted in the upper end of a column portion 18a formed on the back side of the upper tank closure 18. This up-thrusting member 26 is upwardly forced by means of a closing/opening spring 27 which is compressedly provided on the bottom side of the up-thrusting member 26. This up-thrusting member upwardly pushes each of two surfaces of the base portion 24b, which is substantially in parallel with the upper surface of the up-thrusting member 26 either during the opening or the closing of the cap 15, whereby the opening and closing of the cap is maintained.

A laterally extending holder 30 is mounted to the upper part of the side wall of the fuel tank 12 in such a manner as to stretch over the valve mechanism 13. An internal cap 31 is also provided so as to cover the upper part of the holder 30. A tubular joint 32 is coupled with the tip end of the nozzle member 21 which upwardly projects out of the center of the valve mechanism 13, and the upper portion of this joint 32 is supported by the holder 30. The upper portion of the joint 32 is connected to the base end of an S-shaped pipe nozzle 33 (see FIG. 2) communicating with the internal passage of the joint 32. The foremost end of this pipe nozzle 33 extends forwardly to the vicinity of a cylindrical file 36 of the ignition means 14, and has an upwardly oriented opening. A window for flame emission purposes is formed at the position in the internal cap 31 corresponding to the opening.

A rotor 35 for the igniting means 14 and a file 36 are provided at the .front end of the holder 30 in parallel with the valve mechanism 13. The file 36 which has a small diameter, and is fixedly attached to a shaft pin 37 is rotatably supported within the holder 30. The rotor 35 is interposed between the file 36 and the upper surface of the fuel tank 12, and operating recesses are formed on the outer surface of this rotor 35. The lower portion of the shaft pin 37 is inserted into the upper center of the rotor 35 so that the rotor 35 and the file 36 can rotate together. A flint 38 (see FIG. 2) is housed within the holder 30 in such a manner that the foremost end of the flint comes in contact with the circumferential surface of the file 36. A flint thrusting spring 39 is pressedly disposed behind the flint 38 so as to hold the flint 38 against the file 36.

An L-shaped lever member 41 is disposed at the upper part of the valve mechanism 13. This lever member 41 is pivotally supported by means of supporting protuberances 41b formed on both ends on the bottom of a vertical portion 41a, and the supporting protuberances are engaged with recesses 18b (see FIG. 2). The end center portion of a horizontally extending engaging portion 41c is engaged with the nozzle member 21 so that the opening and closing of the valve mechanism 13 can be carried out by the vertical movement of the nozzle 21 in response to the pivotal movement of the lever member 41.

An operating grip 42 is provided on the back side of the fuel tank 12, that is, below the pivot member 24 of the cap 15. This operating grip 42 is composed of a supporting leaf 42a, which is longitudinally formed at a lower position of the operating grip 42, and a trigger portion 42c which is linked to a lower end of the supporting leaf 42a by way of a thin deformable portion 42b. The supporting leaf 42a is engageably supported and fixed between the fuel tank 12 and the upper tank closure 18 (the bottom surface of the column portion 18a). The operating grip 42 vertically extends along an interior lateral surface of the lighter body so that the trigger portion 42c can remain exposed on the exterior lateral surface side of the lighter body 11. Plate-shaped pressing leaves 42d, which extend to the inside of the lighter body 11 along both sides of the column portion 18a of the upper tank closure 18, are formed on both sides of the trigger 42c. In this operating grip 42, the shape of the thin deformable portion 42b is determined so that it can obtain inwardly deformable characteristics which cause the trigger portion 42c to come in contact with the lateral surface of the lighter body 11 when the lighter is left unused. Further, each pressing leaf 42d is provided with a stopper 42e (see FIG. 2) for regulating the maximum projecting position of the trigger portion 42c.

A linkage member 43 is disposed between the pivot member 24, the lever member 41 and the operating grip 42 in order to link operations of these members to one another, and the combination of the linkage member 43 and lever member 41 constitutes a link means 16. In the foregoing linkage member 43, supporting protuberances 43b, projecting from both sides of the base portion 43a which are in the vicinity of the vertical portion 41a of the lever member 41, are supported by the shaft support members 18c (see FIG. 2) standing on both sides of the upper tank closure 18. An upperend notched portion 18d of the shaft support member 18c is longitudinally flush with the upper end of the vertical portion 41a of the lever member 41. The supporting protuberances 43b of the linkage member 43 are received by these notched portions 18d. This linkage member 43 is supported so that it can rotate along the longitudinal direction of the lighter body.

The linkage member 43 has extensions which extend backwards from the linkage member from both sides of the substrate portion 43a past the side of the joint 32, and the linkage member is at the end thereof formed into engaging portions 43c having long recesses which can engage with the engaging protuberances 24d of the pivot member 24. The raised portions 24e of the pivot member 24 can be brought in contact with the upper side portion of the engaging portion 43c. This linkage member 43 is provided with leg portions 43d which obliquely extend downward from the both sides of the base portion 43a so that the leg portion can come in contact with the pressing leaf 42d of the trigger portion 42c of the operating grip 42.

The operation of the gas lighter 10 with the safety device according to one embodiment of this invention having the above structure will now be described in detail.

When the gas lighter is not in use while the cap 15 is closed, the pivot member 24 of the cap 15 positioning at the close position is disengaged from the long recess of the engaging portion 43*c* of the linkage member 43. The linkage member 43 is downwardly rotated and situated at the position where the tip end of the leg portion 43*d* comes in contact with the upper surface of the upper tank closure 18. The leg portion 43*d* does not engage the pressing leaf 42*d* of the trigger portion 42*c* of the operating grip 42, and the trigger portion 42*c* of the operating grip 42 is situated at a non-projecting position where the grip remains in contact with the rear surface of the lighter body 11 because of its resiliency. At this state, the lever member 41 is kept inoperative, and hence it is impossible to cause the lighter to evolve gas by the operation of the nozzle member 21.

While the cap is closed, the engagement of the engaging portion 43*c* with the projecting portion 24*e* of the pivot member 24 deters the rotation of the linkage member 43 to the horizontal level, whereby the rotation of the linkage member to the horizontal level under the weight of the engaging portion 43*c* when the lighter 10 is turned upside down is prevented.

Meanwhile, when the cap 15 is opened, as shown in FIG. 4, the engaging projection 24*d* engages with the long recess of the engaging portion 43*c* of the linkage member 43 in response to the rotation of the pivot member 24 which results from the rotation of the cap 15 for open, whereupon the linkage member 43 is upwardly rotated to a substantially horizontal level. The rotation of the linkage member 43 brings the tip end of the leg portion 43*d* into contact with the pressing leaf 24*d* of the operating grip 42, so that the trigger portion 42*c* is outwardly pivoted around the thin deformable portion 42*b* until it projects out of the lateral surface of the lighter body. Simply while the cap 15 is opened, gas is not evolved because the lever member 41 is not pivotally actuated, and hence the lighter does not cause ignition even when igniting operations are performed using the rotor 35.

While the cap 15 is opened, as shown in FIG. 5, when the trigger portion 42*c* of the operating grip 42 is subsequently depressed, the pressing leaf 42*d* forwardly presses the leg portion 43*d* of the linkage member 43 in response to the depressing operations, so that the linkage member 43 horizontally moves. The horizontal movement of this linkage member 43 causes the base portion 43*a* of the linkage member to press the upper end of the vertical portion 41*a* of the lever member 41, which, in turn, causes the lever member 41 to pivot. As a result of this, the engaging portion 41*c* causes the nozzle member 21 to raise, so that the valve mechanism 13 is opened, and then gas is evolved from the tip end of a pipe nozzle 33 by way of a joint 32. During this time, evolved gas is ignited by sparks produced by the rotation of the file 36 resulting from the operation of the rotor 35 of the ignition means 14. By releasing the depressed trigger 42*c* of the operating grip 42, the nozzle member 21 and the lever 41 return to their original position in a reversed order owing to the elasticity of a spring 22 of the nozzle member 21, whereupon the linkage member 43 is horizontally pressed towards the rear of the linkage member until it returns to the aforementioned state shown in FIG. 4. Thus, the nozzle member 21 is closed, and the evolution of gas is terminated.

After the use of the lighter and the closing of the cap 15, the linkage member 43 downwardly rotates by means of the engaging projection 24*d* in response to the downward rotation of the pivot member 24, which, in turn, cancels the projection of the operating grip 42 by the leg portion 43*d*. As shown in FIG. 3, the trigger portion 42*c* of the operating grip 42 returns to its original position associated with the closing action of the cap 15. During this time, the raised portion 24*e* of the pivot member 24 engages with the engaging portion 43*c* of the linkage member 43, whereupon the linkage member downwardly rotates. Thus, the evolution of gas is terminated by ensuring the interruption of the linkage between the pivot member 24 and the linkage member 43. If the cap 15 is closed during the ignition, the linkage member 43 is forcefully rotated downwards so that the evolution of gas is stopped. In this way, the safety of the lighter is improved to a great extent.

Thus, according to the safety device of this invention, the opening action of the cap 15 is not sufficient to permit the evolution of gas. Gas is evolved only by the depressing operation of the operating grip 42 together with the opening action of the cap 15, whereby inadvertent ignition of the lighter by children is prevented, and the wasteful evolution of gas is reduced.

As is evident from the foregoing descriptions, the present invention is susceptible to any modifications in detail, and it is contemplated that various modifications of the disclosed embodiment, as well as other embodiments of the invention will, without departing from the spirit and scope of the invention, be apparent to persons skilled in the art.

The lighter according to this invention is not limited to a specific type, and the safety device employed in this invention can find applications not only in a flint type lighter as shown in the disclosed embodiment, but in other types of lighters such as an electric lighter.

It will be understood that the above description of the present invention is susceptible to various modifications, changes, and adaptations and that the same are intended to be comprehended within the meaning and range of equivalents of the appended claims.

What is claimed is:

1. A gas lighter with a safety device comprising a lighter body which includes a fuel tank for storing fuel to be ignited and a valve mechanism for supplying fuel from the fuel tank at a regulated flow rate, an ignition means for igniting the supplied fuel, and a flick-up type cap for closing and opening the upper part of the lighter body and the ignition means, an operation grip means which projects from an inactive position against the lighter body to an active position spaced outwardly from the surface of the lighter body in response to the opening of the cap, and a linkage means for actuating the valve mechanism in connection with a depression of the operation grip inwardly toward the inactive position against the lighter body so that gas is evolved.

2. A gas lighter with a safety device as defined in claim 1, wherein the linkage means comprises a linkage member which rotates in response to the opening and closing actions of the cap, and causes the operating grip to project when the linkage member comes in contact with the operating grip, and a lever member at one end thereof engaging with a nozzle member of the valve mechanism and at the other end thereof coming in contact with a base portion of the linkage member so that the lever can pivot to the direction where gas is evolved in connection with the depression of the operating grip by way of the linkage member.

* * * * *